US006527425B1

(12) United States Patent
Nakata

(10) Patent No.: US 6,527,425 B1
(45) Date of Patent: Mar. 4, 2003

(54) METHOD AND APPARATUS USING B-SPLINE REFLECTIVE SURFACE AND CURVED LENS TO RENDER IT DIFFICULT TO SEE REFLECTOR THROUGH LENS

(75) Inventor: Yutaka Nakata, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 0 days.

(21) Appl. No.: 09/618,092

(22) Filed: Jul. 17, 2000

(30) Foreign Application Priority Data

Jul. 23, 1999 (JP) ..... 11-209331

(51) Int. Cl.[7] ..... F21V 7/00

(52) U.S. Cl. ..... 362/516; 362/308; 362/518; 362/520; 362/297

(58) Field of Search ..... 362/516, 308, 362/517, 518, 520, 297, 346

(56) References Cited

U.S. PATENT DOCUMENTS 4,704,661 A * 11/1987 Kosmatka ..... 362/346
5,204,820 A * 4/1993 Strobel et al. ..... 364/468
5,532,909 A * 7/1996 Ban et al. ..... 362/518

* cited by examiner

*Primary Examiner*—Sandra O'Shea
*Assistant Examiner*—Ronald E. Delgizzi
(74) *Attorney, Agent, or Firm*—Foley & Lardner

(57) ABSTRACT

A first reflection surface of a reflector is set up for a first brightness-intensity distribution pattern to be projected through a flat lens to conform to a target brightness-intensity distribution pattern. A displacement between the target brightness-intensity distribution pattern and a second brightness-intensity distribution pattern is calculated, the second brightness-intensity distribution pattern being reflected by the first reflection surface and to be projected through a curved lens. A second reflection surface of the reflector is set up for the displacement to become substantially a zero.

7 Claims, 15 Drawing Sheets

Z
Rhi
Rho
Sh
Z
C

B
Bl
Br
B
C
Ar
Al

Sv
Z
D
Z
T
Rvo
Rvi
F

FIG.13

| REFLECTOR 2, 6, 7 | | |
|---|---|---|
| LENGTH | HEIGHT | FOCAL DISTANCE |
| Ar(mm) | Br(mm) | F(mm) |
| 120 | 80 | 22 |

FIG.14

| LIGHT SOURCE 1 | | | | DISTANCE BETWEEN LENS 3, 4, 5 AND REFLECTOR 2, 6, 7 |
|---|---|---|---|---|
| TYPE | LIGHT RAYS | LENGTH OF FILAMENT | RADIUS OF FILAMENT | |
| | (lm) | Lf(mm) | Rf(mm) | (mm) |
| H11 | 1150 | 4.6 | 0.73 | 90 |

FIG.15

| LENS 3, 4, 5 | | | | | | | | | |
|---|---|---|---|---|---|---|---|---|---|
| | LENGTH | HEIGHT | THICKNESS | INCLINATION ANGLE | | RADIUS OF CURVATURE OF SURFACE | | RADIUS OF CURVATURE OF BACK SURFACE | |
| | Al(mm) | Bl(mm) | T(mm) | Sv(° ) | Sh(° ) | Rvo(mm) | Rho(mm) | Rvl(mm) | Rhi(mm) |
| FLAT LENS 2 | 200 | 180 | 3 | 15 | 15 | 203 | 1003 | 200 | 1000 |
| CONCAVE LENS 4 | 200 | 180 | 3 | 15 | 15 | 1200 | 1400 | 200 | 500 |
| CONVEX LENS 5 | 200 | 180 | 30 | 15 | 15 | 200 | 300 | 800 | 1400 |

FIG.16

| ECEReg. | | SATISFACTION |
|---|---|---|
| MAXIMUM BRIGHTNESS INTENSITY (cd) | | 20,085 |
| UTILIZATION BRIGHTNESS INTENSITY (lm) | | 458 |
| LIGHT PROJECTING PART OF FLAT LENS 3 (mm) | HEIGHT | 88 |
| | LENGTH | 120 |
| | THICKNESS | 3 |
| DEPTH OF REFLECTOR 2 (mm) | | 61 |

FIG.17

| ECEReg. | | SATISFACTION |
|---|---|---|
| MAXIMUM BRIGHTNESS INTENSITY (cd) | | 19,233 |
| UTILIZATION BRIGHTNESS INTENSITY (lm) | | 518 |
| LIGHT PROJECTING PART OF CONCAVE LENS 4 (mm) | HEIGHT | 70 |
| | LENGTH | 120 |
| | THICKNESS | 3 |
| DEPTH OF REFLECTOR 6 (mm) | | 64 |

FIG.18

| ECEReg. | | SATISFACTION |
|---|---|---|
| MAXIMUM BRIGHTNESS INTENSITY (cd) | | 20,466 |
| UTILIZATION BRIGHTNESS INTENSITY (lm) | | 749 |
| LIGHT PROJECTING PART OF CONVEX LENS 5 (mm) | HEIGHT | 105 |
| | LENGTH | 130 |
| | THICKNESS | 30 |
| DEPTH OF REFLECTOR 7 (mm) | | 55 |

FIG.19

| | EFFECTIVE UTILIZATION LIGHT RAYS (%) | PROJECTING AREA RATIO (%) | DEPTH RATIO (%) |
|---|---|---|---|
| FLAT LENS 3 | 100 | 100 | 100 |
| CONCAVE LENS 4 | 113 | 85 | 105 |
| CONVEX LENS 5 | 82 | 121 | 90 |

FIG.20

$$P(u,v) = \sum_{j=0}^{m} \sum_{k=0}^{n} P_{j,k} N_{j,s}(u) \, N_{k,t}(v) \quad \text{----------} \quad (1)$$

FIG.21

$$\left.\begin{aligned}
N_{j,s}(u) &= \begin{cases} 1 \ (u_j \leqq u < u_{j+1}) \\ 0 \ (u < u_j, \ u \geqq u_{j+1}) \end{cases} \\
N_{j,s}(u) &= \frac{u - u_j}{u_{j+s+1} - u_j} N_{j,s-1}(u) + \frac{u_{j+s} - u}{u_{j+s} - u_{j+1}} N_{j+1,s-1}(u) \\
N_{k,t}(v) &= \begin{cases} 1 \ (v_k \leqq v < v_{k+1}) \\ 0 \ (v < v_k, \ v \geqq v_{k+1}) \end{cases} \\
N_{k,t}(v) &= \frac{v - v_k}{v_{k+t-1} - v_k} N_{k,t-1}(v) + \frac{v_{k+t} - v}{v_{k+t} - v_{k+1}} N_{k+1,t-1}(v)
\end{aligned}\right\} \text{---- (2)}$$

METHOD AND APPARATUS USING B-SPLINE REFLECTIVE SURFACE AND CURVED LENS TO RENDER IT DIFFICULT TO SEE REFLECTOR THROUGH LENS

BACKGROUND OF THE INVENTION

The present invention relates to a headlamp where control on a pattern of brightness-intensity distribution is performed mainly by a reflector, and in particular to a headlamp whose interior is made difficult to see to some extent without losing a high brightness feeling of inside metal and which has a high degree of freedom on an optical design and a method for manufacturing a reflector in the headlamp.

There have been known a headlamp which uses a flat lens. However, the headlamp uses the flat lens, and the inside (lamp chamber) of the headlamp can be seen clearly through the flat lens. The inside can be seen clearly, and it is necessary to finish the interior of the lamp chamber politely, and correspondingly the inside finishing is complicated.

Also, since the reflected light reflected and controlled by the reflector is allowed to pass through the flat lens as it is without controlling the reflected light, the degree of freedom on the optical system design is small.

SUMMARY OF THE INVENTION

An object of the present invention is to provide a headlamp whose inside is made difficult to see to some extent without losing a high brightness feeling of inside metal and whose degree of freedom is large on an optical system design and a method for manufacturing a reflector for the headlamp.

In order to achieve the above object, a first aspect of the invention provides a manufacturing method for a reflector of a headlamp. The method has the steps of setting up a first reflection surface of a reflector for a first brightness-intensity distribution pattern to be projected through a flat lens to conform to a target brightness-intensity distribution pattern; calculating a displacement between the target brightness-intensity distribution pattern and a second brightness-intensity distribution pattern, the second brightness-intensity distribution pattern being reflected by the first reflection surface and to be projected through a curved lens; and setting up a second reflection surface of the reflector for the displacement to become substantially a zero.

A second aspect of the invention provides a headlamp. The headlamp has a reflector having a second reflection surface for reflecting light rays from a light source; and a curved lens for projecting reflected light rays to outside therethrough. The second reflection surface is set up relative to a first reflection surface to conform a second brightness-intensity distribution to be projected through the curved lens to a target brightness-intensity distribution pattern. The first reflection surface is for conforming a first brightness-intensity distribution pattern to be projected through a flat lens to the target brightness-intensity distribution pattern.

Preferably, the curved lens has a concave surface.

Preferably, the curved lens has a convex surface.

Preferably, the curved lens has a concave surface and a convex surface. The second reflection surface of the reflector conforms a third brightness-intensity distribution pattern to pass through the concave surface and a fourth brightness-intensity distribution pattern to pass through the convex surface to a target brightness-intensity distribution pattern respectively.

As a result, since the headlamp of the present invention uses the concave lens (4) or the convex lens (5), when the inside of the headlamp is seen through the concave lens (4) or the convex lens (5), it becomes difficult to see the inside to some extent due to light refraction (refer to solid line arrows L24, L34, L25, L35 in FIG. 1) without losing a high brightness feeling of inside metal. Accordingly, it is unnecessary to perform the inside finishing of the headlamp so politely and correspondingly the inside finishing is made easy.

Also, since the reflected light (L24, L25) reflected and controlled by the reflector (6,7) is further refracted and controlled by the concave lens (4) and/or the convex lens (5) to be projected as projecting light (L34, L35) outside, the degree of freedom on optical system design is increased as compared with the case using the flat lens (3).

According to the method for manufacturing a reflector for a headlamp of the invention, the reflector (6, 7) for a headlamp whose inside is made difficult to see to some extent without losing a high brightness feeling of inside metal and whose degree of freedom is large on an optical system design can be manufactured. In addition, the reflector (6, 7) for the above-mentioned headlamp can be manufactured with a high accuracy, at a high speed and with a high degree of freedom by performing the provisionally setting step of the reflector (2), the displacement calculating step and the primarily setting step of the reflector (6, 7) according to a predetermined program in a computer.

In other words, the target brightness-intensity distribution pattern can be obtained by a reflection surface of the reflector (2) manufactured according to a general expression and parametric functions which have been changed on the basis of the general expression of the equation (1) and the parametric functions of the equation (2).

BRIEF DESCRIPTION OF THE DRAWINGS

FIG. 13 shows size data of a reflector;

FIG. 14 shows size data of a light source;

FIG. 15 shows size data of respective lenses;

FIG. 16 shows a simulation result for a flat lens;

FIG. 17 shows a simulation result for a concave lens;

FIG. 18 shows a simulation result for a convex lens;

FIG. 19 shows a comparison of a flat lens, a concave lens, and convex lens;

FIG. 20 shows an expression (1); and

FIG. 21 hows expressions (2).

DETAILED DESCRIPTION OF THE PREFERRED EMBODIMENT

Firstly, a comprehension of the invention is explained.

Figure 8:
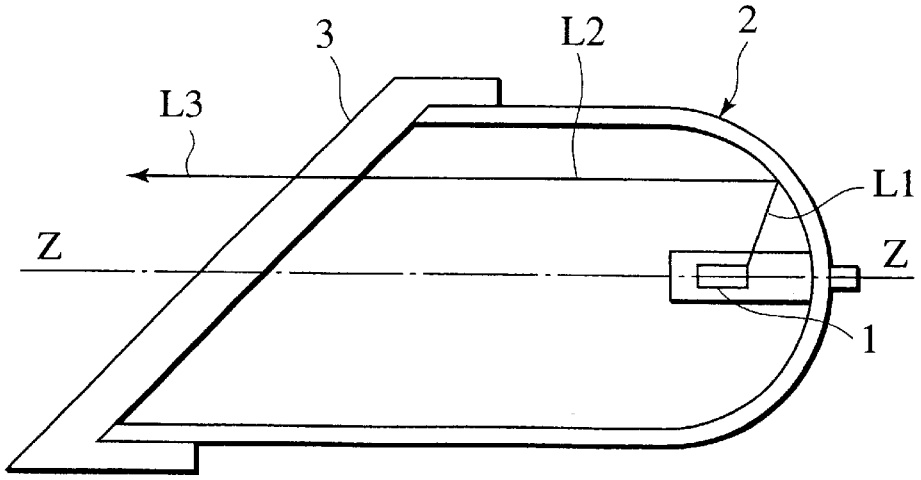
FIG. 8 is a schematic longitudinal sectional view of a conventional headlamp where a flat lens has been used.

In FIG. 8, reference numeral 1 denotes a light source. A halogen lamp with a single filament or a double filament, an incandescent lamp, a discharge lamp and the like (so-called H1, H3, H4, H7, H11, and the like) can be used as the light source 1. The light source 1 is disposed in a lamp chamber 10 described later.

Figure 9:
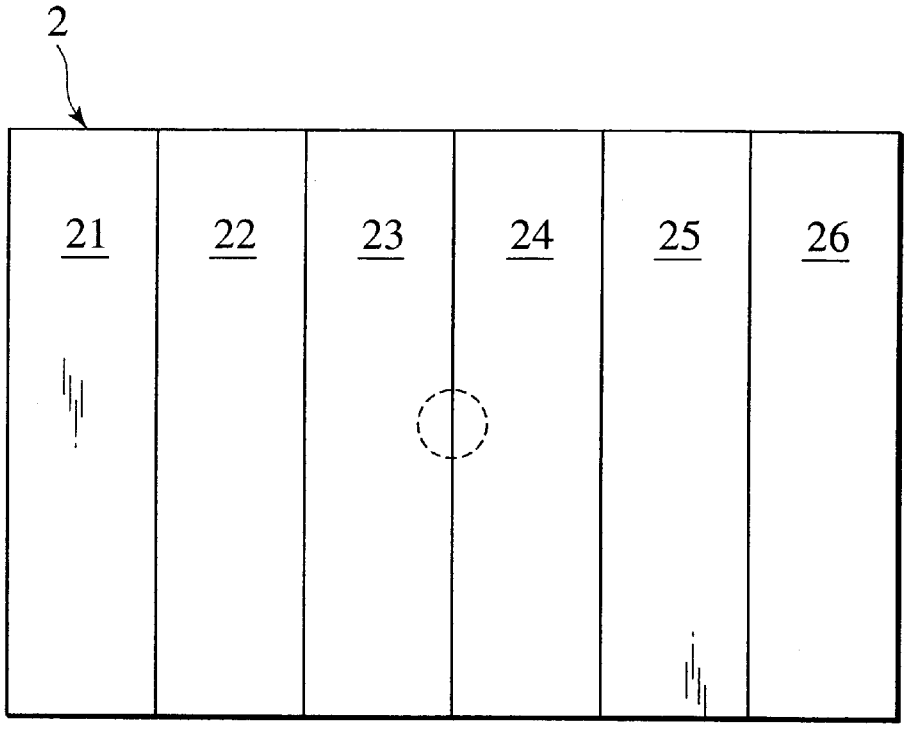
FIG. 9 is a surface view of a reflector of the conventional headlamp.

In FIG. 8, reference numeral 2 denotes a reflector. The reflector 2 has a reflection surface of free curved surfaces combined compositionally. The reflection surface of the reflector 2 develops a high brightness feeling of metal by aluminum deposition, silver coating or the like. Also, as shown in FIG. 9, the reflector 2 in this example is vertically divided into 6 pieces. There are a case that boundary lines (seams) of reflection surface blocks (or reflection surface segments) 21, 22, 23, 24, 25 and 26 (21 to 26) can be seen because the reflection surface blocks 21 to 26 are independent from one another, as shown in FIG. 9, and a case that the lines can not be seen because the reflection surface blocks 21 to 26 are continuous. Also, in the reflector 2, the reflector surface blocks are formed by dividing the reflector surface in a vertical direction. However, the reflector surface may be divided in a horizontal direction or a radial direction, or it may be formed by combining a vertical direction division, a horizontal direction division and a radial direction division appropriately. That is, taking a design for the reflector into consideration, the reflection surface of the reflector 2 is divided in blocks.

The detail of the reflector 2 comprising the above-mentioned free curved surfaces has been described, for example in "Mathematical Elements for Computer Graphics" (Devid F. Rogers, J Alan Adams). That is, in a case where a flat lens 3 described later has been used, the reflection surface of the above-mentioned reflector 2 can be obtained according to a general expression of the expression (1) as shown in FIG. 20.

The expressions (2), as shown in FIG. 21, are shown as parametric functions of the general expression of the following expression (1). A specific reflection surface of the above-mentioned reflector 2 in the case that the flat lens 3 described later has been used can be obtained by substituting specific numerical values, for example, points on a paraboloid for the parametric functions of the expressions (2).

The focus F of the reflector 2 is not a single focus in a strict sense, but because displacements in focal distance are only slight among the plurality of reflection surfaces and the reflection surfaces share an approximately identical focus, the approximately identical focus is called as a pseudo-focus (or simply focus) in this specification. Similarly, the optical axis Z—Z of the reflector 2 is not a single optical axis in a restrict sense. Since displacements in optical axis are only slight among them and the optical axis has the approximately identical optical axis, the approximately same optical axis is called a pseudo-optical axis (or simply optical axis) Z—Z in the present specification and the drawings.

Incidentally, the reflector, 2 is integrated with a lamp housing, but it may be a member different from the lamp housing.

In FIG. 8, reference numeral 3 denotes a lens. The lens 3 is a flat lens whose inner surface and outer surface are substantially parallel to each other, so-called plain lens (which is called flat lens in this specification). Incidentally, the inner surface and the outer surface of the flat lens 3 may be plain surfaces or curved surfaces. A lamp chamber 10 is defined by the flat lens 3 and the above-mentioned reflector 2.

Figure 10:
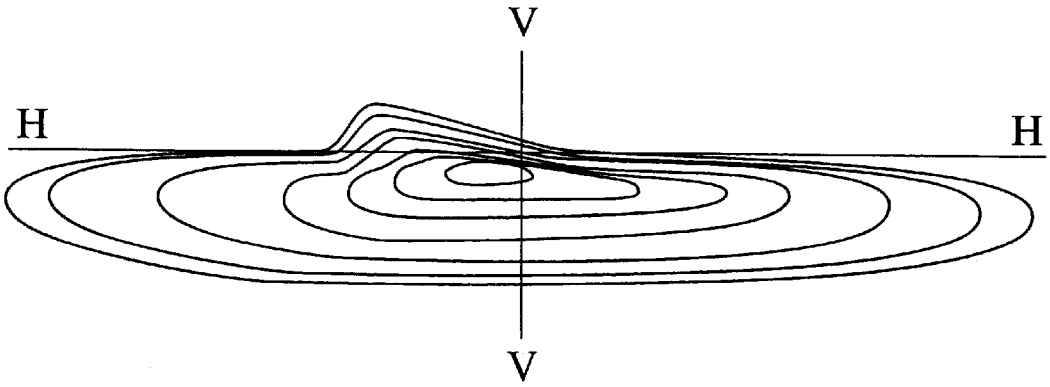
FIG. 10 is a predetermined brightness-intensity distribution pattern diagram (equibrightness curve diagram) of a low light rays.

When the light source 1 is turned on, light L1 from the light source 1 is reflected by the reflector 2 and the reflected light L2 is irradiated as projecting light L3 with a predetermined brightness-intensity distribution pattern through the flat lens 3 outside. Here, the predetermined brightness-intensity distribution pattern means a brightness-intensity distribution pattern satisfying such a standard of brightness-intensity distribution as EC brightness-intensity distribution standard ECEReg., or a standard corresponding thereto (for example, Japanese type approval standard or the like), North American brightness-intensity distribution standard FMVSS or the like. The predetermined brightness-intensity distribution pattern in this example is a brightness-intensity distribution pattern of a low light rays, as shown in FIG. 10. The brightness-intensity distribution pattern of the low light rays shown here is one for a headlamp equipped in a vehicle for a left side running division. A brightness-intensity distribution pattern of a low light rays of a head lamp equipped with a vehicle for a right side running division is reversed to the brightness-intensity distribution pattern of the low light rays shown regarding left and right sides.

Figure 11A:
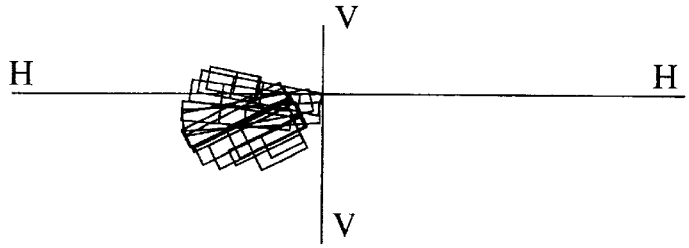
FIGS. 11A to 11F are explanatory diagrams of brightness-intensity distribution patterns which are obtained by a flat lens shown in FIG. 8 and a reflector shown in FIGS. 8 and 9 and where brightness-intensity distribution patterns have been obtained by simulation of a computer are simplified.
Figure 11B:
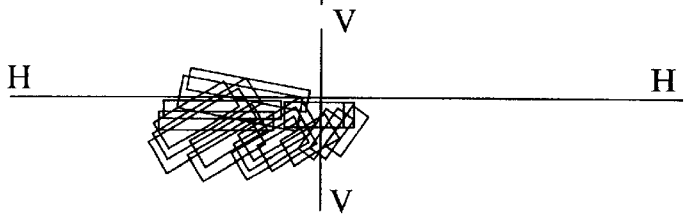
Figure 11C:
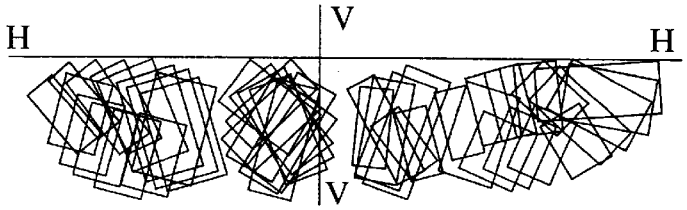

A predetermined brightness-intensity distribution pattern of the low light rays shown in FIG. 10 is controlled by the respective reflection surface blocks 21 to 26 of the reflector 2. That is, in the reflector 2 shown in FIG. 9, a brightness-intensity distribution pattern shown in FIG. 11A is controlled by the reflection surface block 21 positioned at the first position from the left side. A brightness-intensity distribution pattern shown in FIG. 11B is controlled by the reflection surface block 22 positioned at the second position from the left side. A brightness-intensity distribution pattern shown in FIG. 11C is controlled by the reflection surface block 23 positioned at the third position from the left side.

Figure 11D:
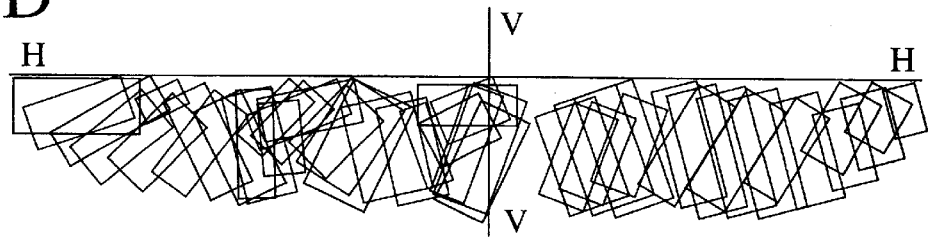
Figure 11E:
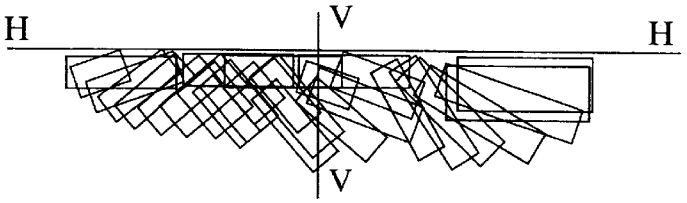
Figure 11F:
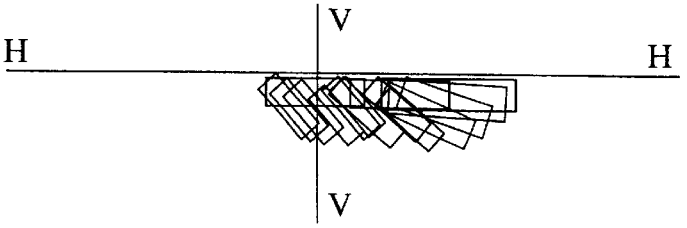

A brightness-intensity distribution pattern shown in FIG. 11D is controlled by the reflection surface block 24 positioned at the fourth position from the left side. A brightness-intensity distribution pattern shown in FIG. 11E is controlled by the reflection surface block 25 positioned at the fifth position from the left side. A brightness-intensity distribution pattern shown in FIG. 11F is controlled by the reflection surface block 26 positioned at the sixth position from the left side. The brightness-intensity distribution patterns (FIGS. 11A, 11B, 11C, 11D, 11E, and 11F) are synthesized so that the predetermined brightness-intensity distribution pattern of the low light rays shown in FIG. 10 can be obtained.

Incidentally, besides the brightness-intensity distribution pattern of the low light rays shown in FIG. 10, another predetermined brightness-intensity distribution pattern of a high light rays (not shown) can be obtained by a light source (not shown) for a high light rays and a reflector (not shown). Next, setting steps of a reflector are explained when a convex lens or a concave lens is adapted.

First, in FIG. 1, in the provisionally setting step for the reflector 2, the reflector 2 is provisionally set such that the target predetermined brightness-intensity distribution pattern (refer to FIGS. 10 and 11) can be obtained by the flat lens 3 and the reflector 2 which are shown with broken lines. At this time, optical paths in the provisionally set reflector 2 and flat lens 3 become optical paths indicated with symbols L1, L2 and L3 and shown with broken line arrows.

Next, in the displacement calculating step, the flat lens 3 is replaced with the concave lens 4 or the convex lens 5 shown with a solid line while the provisionally set reflector 2 is maintained as it is. The projecting light L4, L5 is refracted in the concave lens 4 or the convex lens 5, as shown with a double dotted line and indicated by symbols L1, L2, L4, L5. Accordingly, since the displacement occurs between the target brightness-intensity distribution pattern (refer to FIG. 11) obtained by the provisionally set reflector 2 and flat lens 3 and the brightness-intensity distribution pattern (refer to FIGS. 2 and 3) obtained by the provisionally set reflector 2 and the concave lens 4 or the convex lens 5, it is calculated.

Then, in the primarily setting step of the reflector 6, 7, the reflector 6 for the concave lens 4, the reflector 7 for the convex lens 5 which is shown with a solid line is primarily set in place of the provisionally set reflector 2, so that the above-mentioned displacement becomes zero. That is, the projecting light L3 (a broken line arrow in FIGS. 1A and 1B) obtained by the flat lens 3 and the provisionally set reflector 2, the projecting light L34 (a solid line in FIG. 1A) obtained by the concave lens 4 and the reflector 6, and the projecting light L35 (for example, a solid line in FIG. 1B) obtained by the convex lens 5 and the reflector 7 become approximately parallel to one another.

Figure 1A:
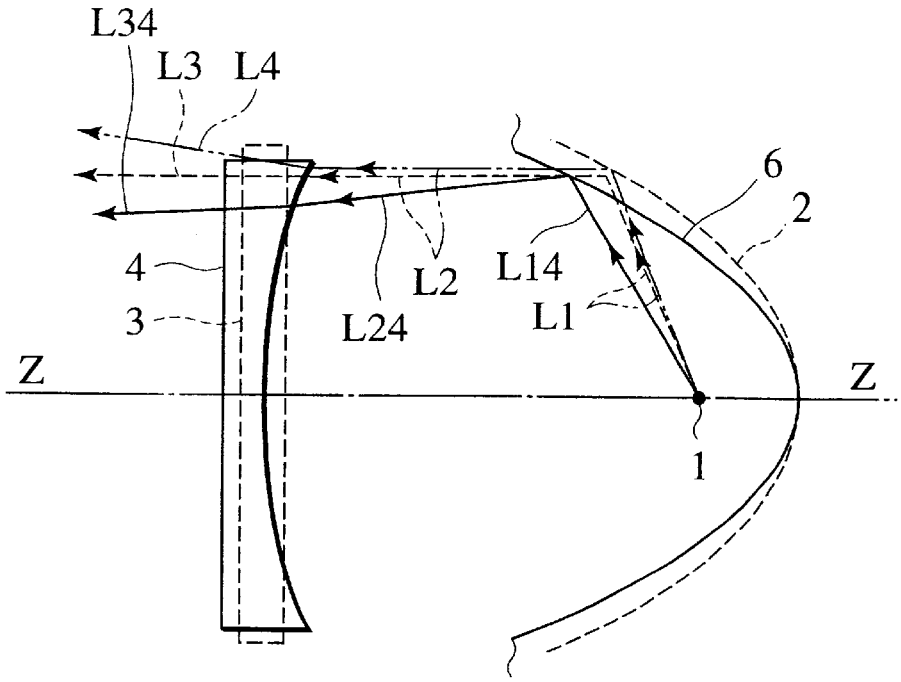
FIG. 1A is an explanatory diagram showing a concept of the present invention in a case that a concave lens is used.
Figure 1B:
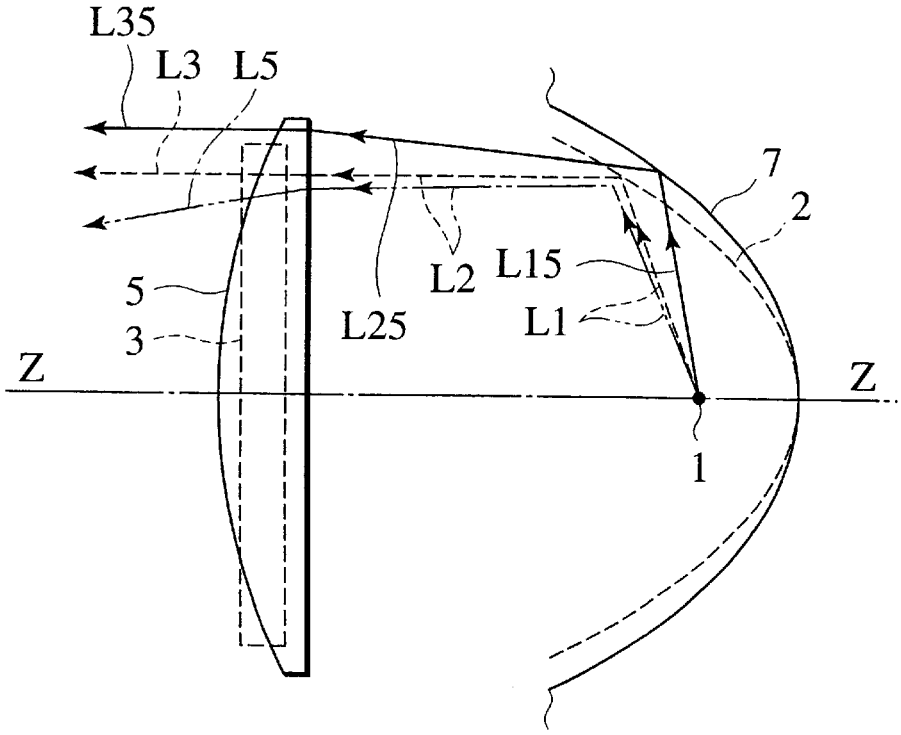
FIG. 1B is an explanatory diagram showing a concept of the present invention in a case that a convex lens is used.
Figure 2A:
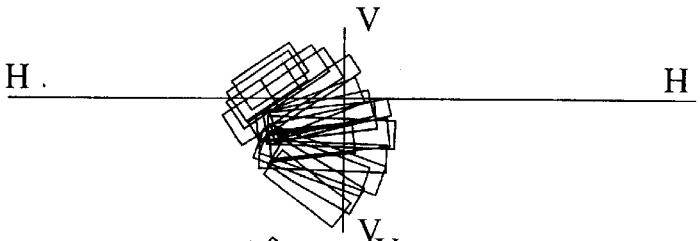
FIGS. 2A to 2F are explanatory diagrams of brightness-intensity distribution patterns which are obtained by the concave lens shown in FIG. 1A and a reflector shown in FIGS. 8 and 9 and where brightness-intensity distribution patterns have been obtained by simulation of a computer are simplified.
Figure 2B:
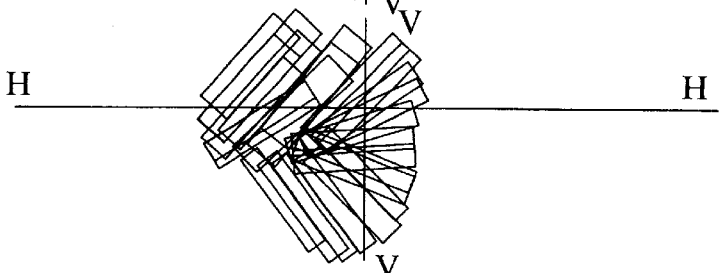
Figure 2C:
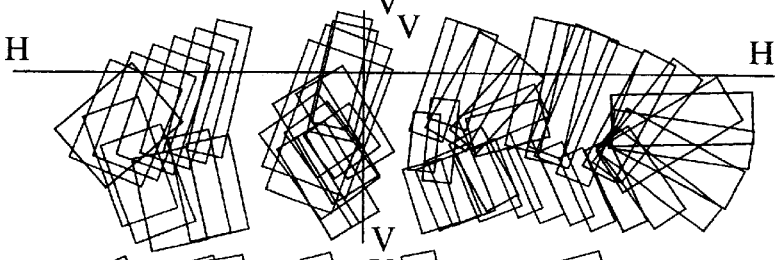
Figure 2D:
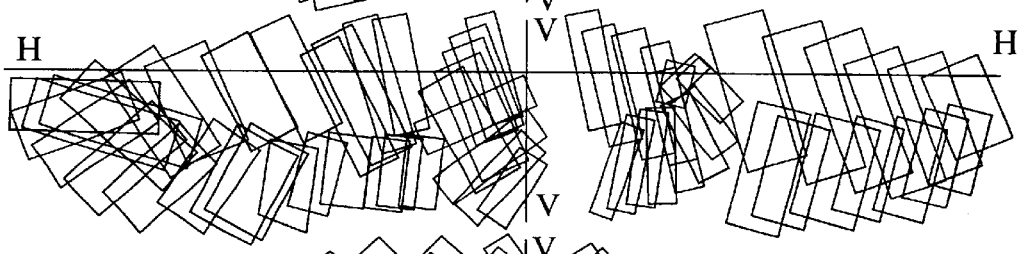
Figure 2E:
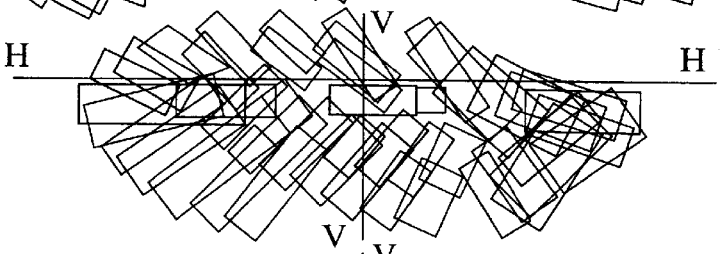
Figure 2F:
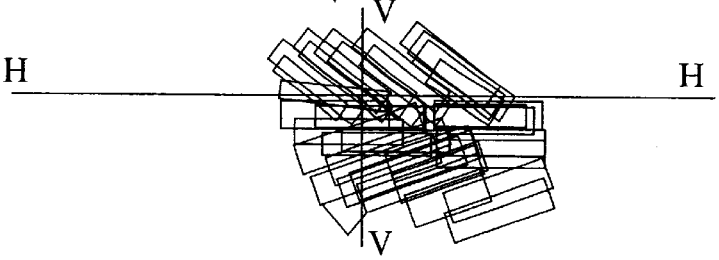
Figure 3A:
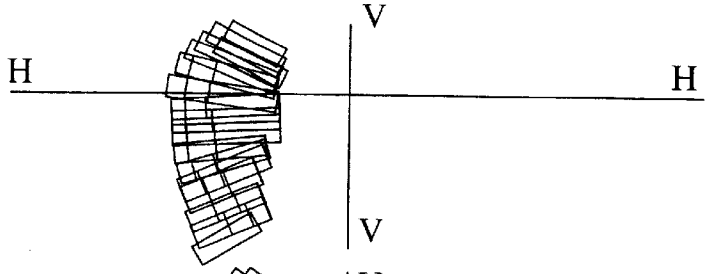
FIGS. 3A to 3F are explanatory diagrams of brightness-intensity distribution patterns which are obtained by the convex lens shown in FIG. 1B and a reflector shown in FIGS. 8 and 9 and where brightness-intensity distribution patterns have been obtained by simulation of a computer are simplified.
Figure 3B:
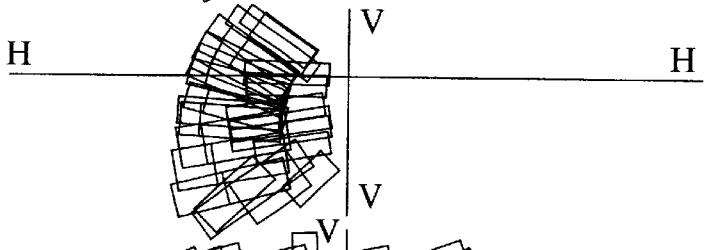
Figure 3C:
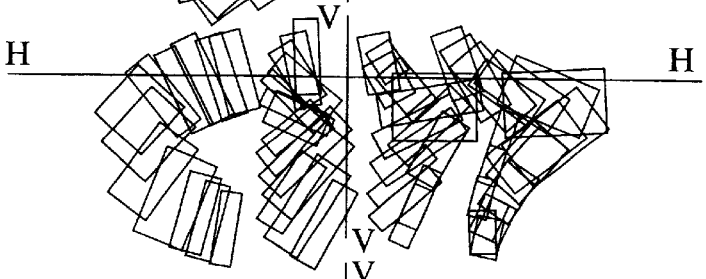
Figure 3D:
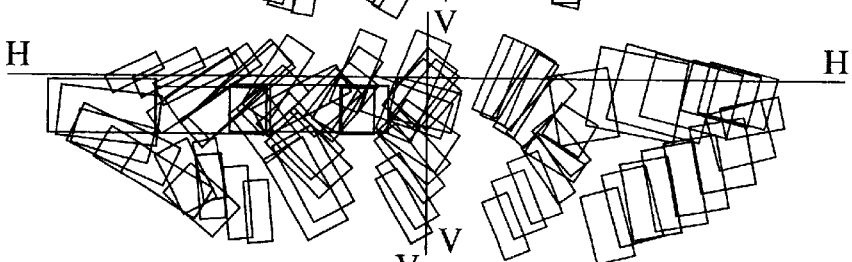
Figure 3E:
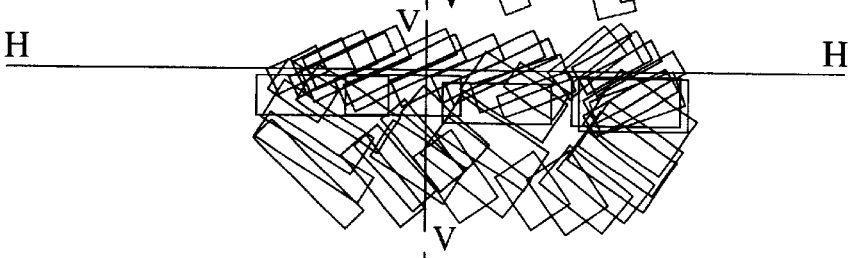
Figure 3F:
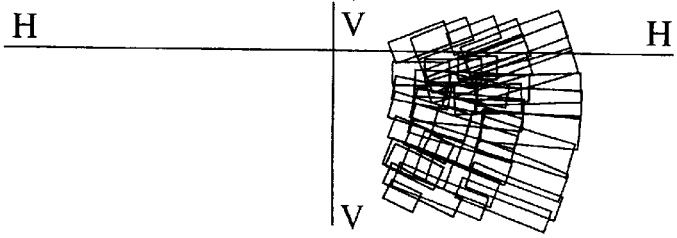

As a result, the optical path obtained by the concave lens 4 and the reflector 6 become the optical path shown with the solid line arrow and denoted by the symbols L14, L24, L34 in FIG. 1A. The optical path obtained by the convex lens 5 and the reflector 7 becomes the optical path shown with the solid lien arrow and denoted by the symbols L15, L25, L35 in FIG. 1B. Therefore, the above-mentioned displacement becomes 0. In this manner, the target predetermined brightness-intensity distribution pattern ( FIGS. 10 and 11) can be obtained.

Incidentally, in FIGS. 1, for interpreting the figures, the broken line arrow and the double dotted line arrow of the light L1 from the light source 1 and the reflected light L2 are shown in the figures in a separated manner, but they are actually positioned on the same optical path.

One embodiment of a headlamp of the present invention and a method for manufacturing a reflector for the headlamp will be explained with reference to FIGS. 4 to 19.

Figure 12:
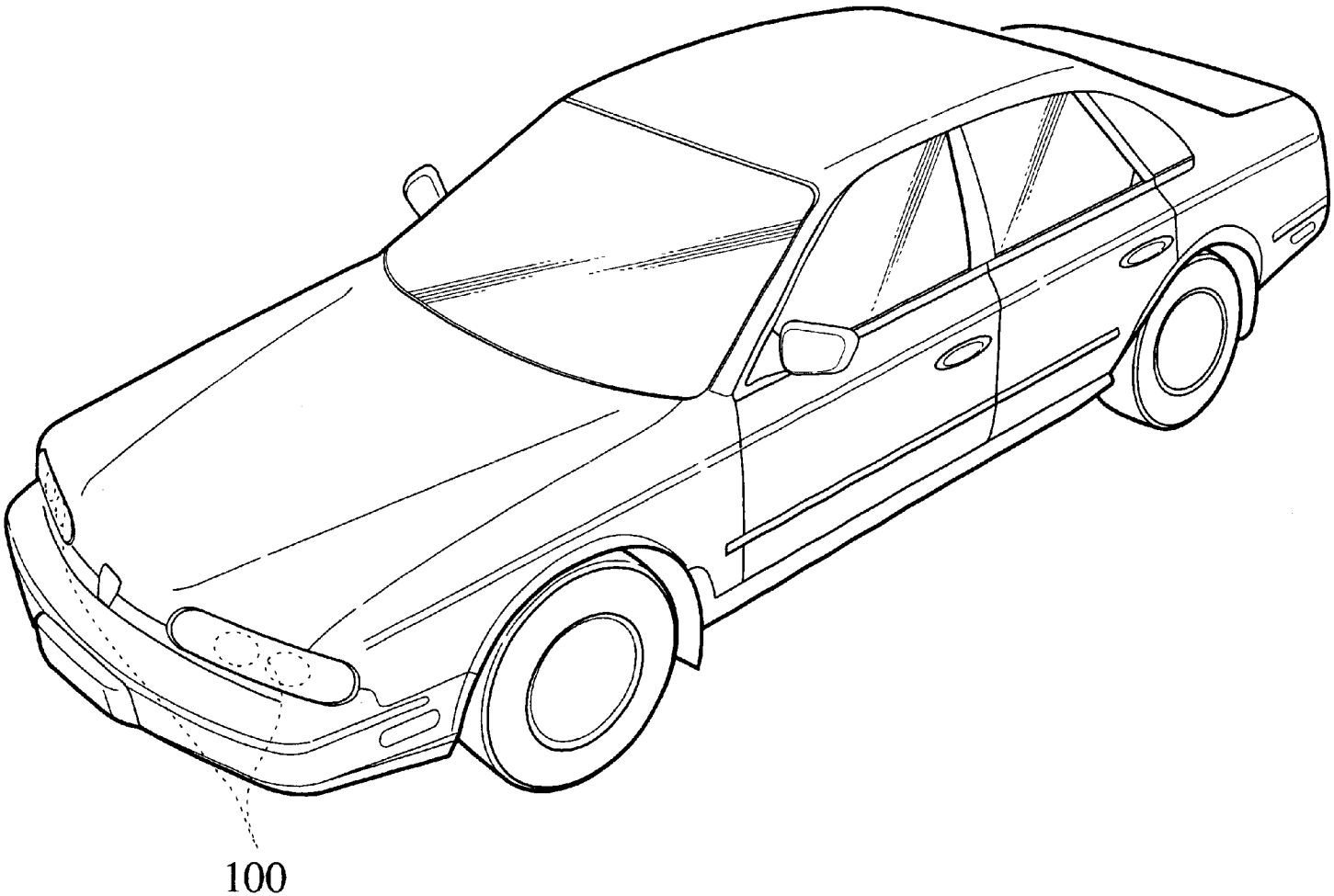
FIG. 12 is a perspective view of an automobile to which a headlamp according to the invention is adapted.

Incidentally, a headlamp 100 shown in FIG. 12 is one equipped on an automobile for a left side running division, and a headlamp equipped on an automobile for a right side running division is reversed to the shown headlamp regarding left and right sides.

Figure 4A:
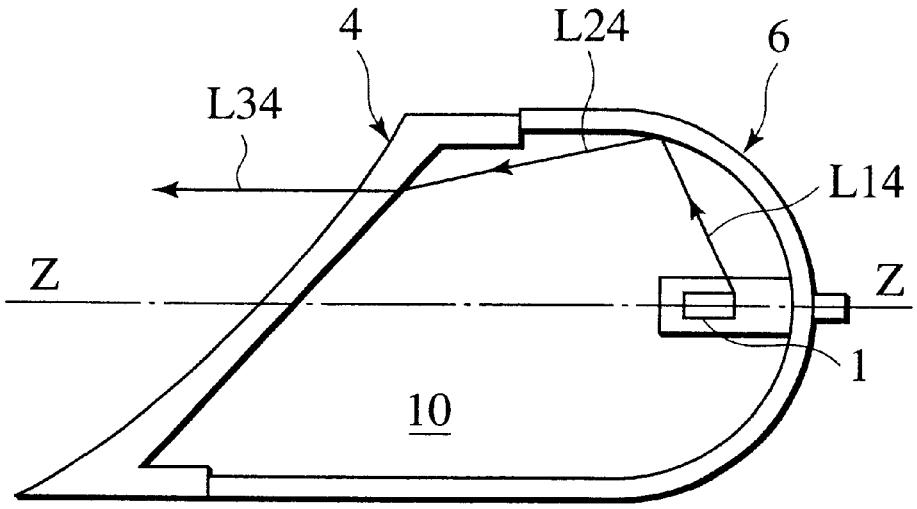
FIGS. 4A and 4B show one embodiment of a headlamp of the present invention, FIG. 4A beings schematic sectional view in a case that a concave lens has been used and FIG. 4B being a schematic sectional view in a case that a convex lens has been used.
Figure 4B:
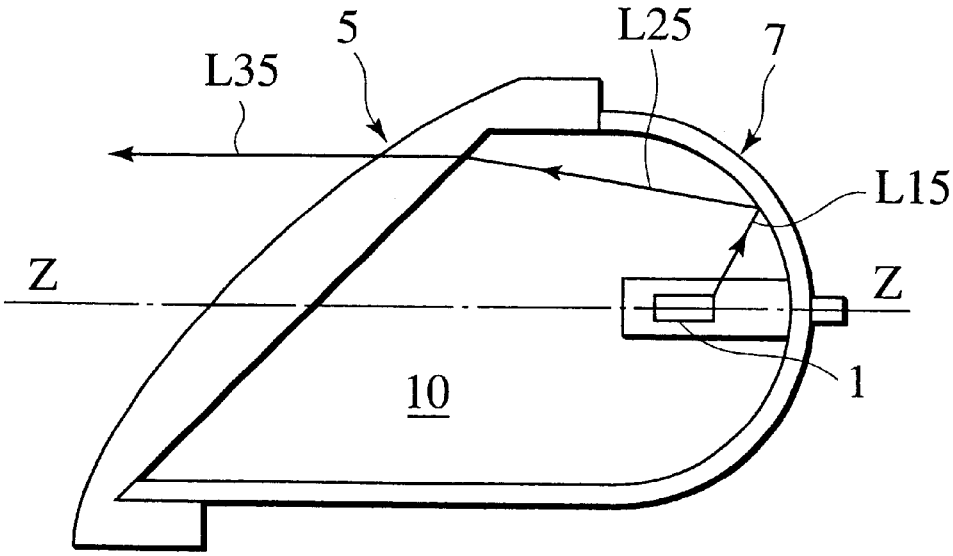

FIGS. 4A and 4B are schematic sectional views showing one embodiment of a headlamp of the present invention.

In FIG. 4A, a concave lens 4 is used as a lens. Also, a reflector 6 which can control projecting light L34 transmitted through the concave lens 4 to a predetermined brightness-intensity distribution pattern is used as a reflector.

Also, in FIG. 4B, a convex lens 5 is used as the lens. Also, a reflector 7 which can control projecting light L35 transmitted through the convex lens 5 to a predetermined brightness-intensity distribution pattern is used as the reflector.

A torus curved surface or a free curved surface is used for a surface (a surface positioned on a reverse side of a surface opposed to a lamp chamber 10) of the concave lens 4 or the convex lens 5 and a back surface (surface opposed to the lamp chamber 10) thereof. Also, a free curved surface is used for a surface (surface opposed to the lamp chamber 10, or reflection surface) of the reflector 6 or 7. Also, the reflector 6 or 7 comprises 6 vertically divided reflection surface blocks like the reflector 2 shown in FIG. 9. Incidentally, NURBS (Non-Uniform Rational B-Spline Surface) is used as the above-mentioned free curved surface.

Since the headlamp of the present invention in this embodiment is structured in the above manner, as shown in FIGS. 4A and 4B, when the light source 1 is turned on, light L14, L15 from the light source 1 is reflected by the reflector 6 or 7. Reflected light L24, L25 is projected as projecting light L34, L35 in a predetermined brightness-intensity distribution pattern of a low light rays shown in FIG. 11 through the convex lens 4 or the concave lens 5 outside.

In this manner, since the headlamp of the present invention in this embodiment employs the concave lens 4 or the convex lens 5, when the interior of the lamp chamber 10 is seen through the concave lens 4 and the convex lens 5, it becomes difficult to see to some extent without losing a high brightness feeling of inside metal owing to refraction of light (refer to solid line arrows L24, L34, L25 and L35 in FIG. 4). Accordingly, it becomes unnecessary to perform an inside finishing so politely, and correspondingly the inside finishing can be performed easily. Also, since the reflected light L24, L25 which has been reflected and controlled by the reflector 6, 7 can be projected as the projecting lights L34, L35 outside by refracting and controlling them through the concave lens 4, the convex lens 5, the degree of freedom on optical system design is made larger than that in the flat lens 3.

Figure 5:
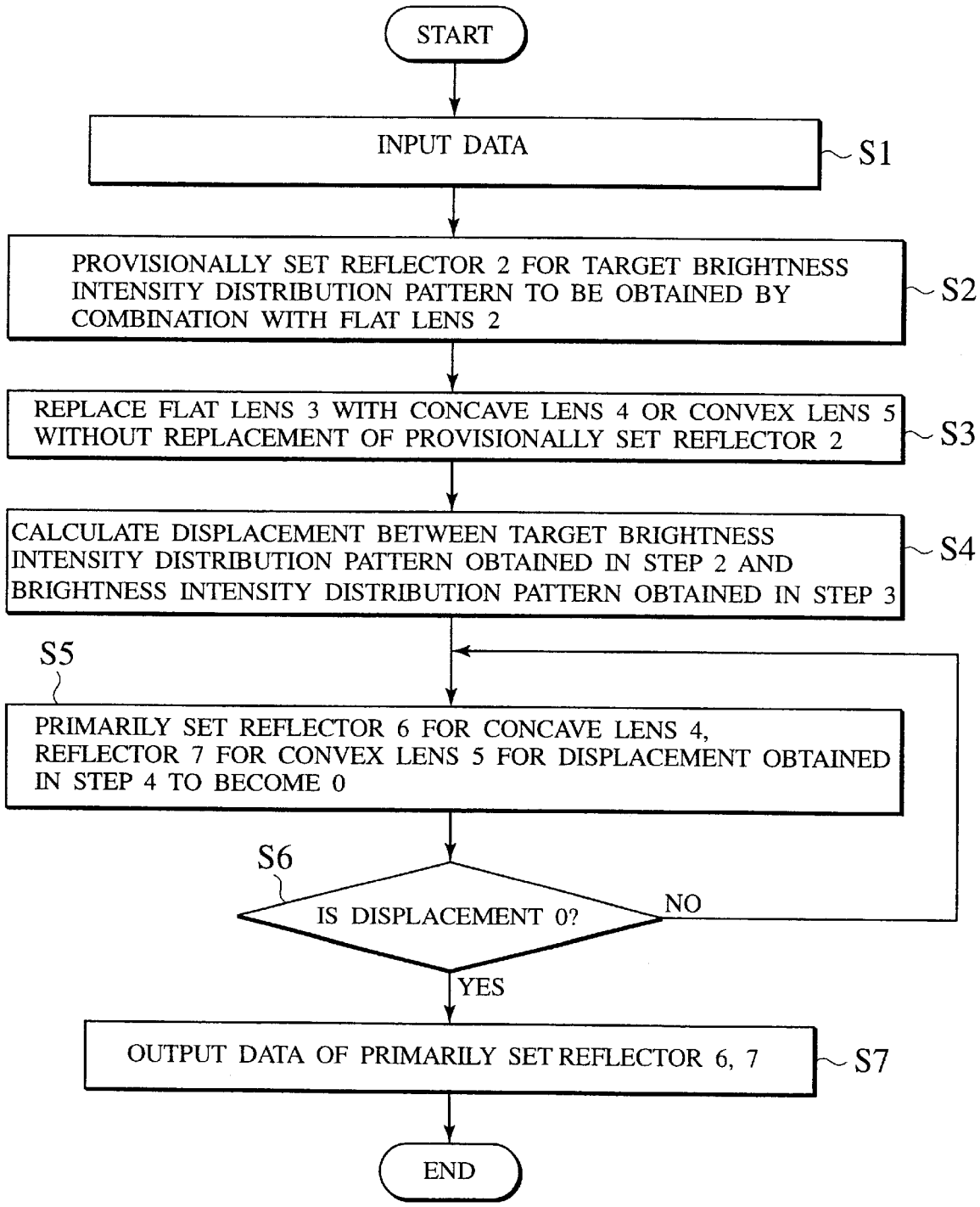
FIG. 5 is a flowchart showing one embodiment of a method for manufacturing a reflector in the headlamp of the present invention.

FIG. 5 is a flowchart showing one embodiment of a method for manufacturing a reflector in the headlamp of the present invention.

The embodiment of the method for manufacturing a reflector in the headlamp of the invention will be explained below with reference to FIG. 5.

In Step 1, first, data is input into a microcomputer (not shown). The data is selected from, for example, design specification and the like, taking into consideration a design of a headlamp itself and a design of an automobile equipped with the headlamp. As the data, there are the kind of the light source 1, the size and surface shape of the reflector 2, 6, 7, the reflection surface block division of the reflector 2, 6, 7, the size, surface shape and back surface shape of the lens 3, 4, 5, a target brightness-intensity distribution pattern, and the like.

Next, in Step 2, a processing is performed that the reflector is provisionally set on the basis of the data input in the above Step 1 such that a target brightness-intensity distribution pattern (FIGS. 10, 11) can be obtained by combination with the flat lens 2. The temporary setting of the reflector 2 is automatically performed on the basis of the control point in the free curved surface of NURBS, the normal vector and the like.

Then, in Step 3, a processing is performed that the flat lens 3 is replaced with the concave lens 4 or the convex lens 5 while the provisionally set reflector 2 which has been obtained by the processing in the above Step 2 is maintained. At this time, the brightness-intensity distribution pattern (FIG. 2, 3) of an image can be obtained through calculation by Ray-tracing technique, the image to be produced by reflecting light L1 from a modeled light source 1 by the reflector 2 and to refract the reflected light L2 at the concave lens 4 or the convex lens 5 so that the refracted light reaches a screen (not shown) ahead of the lens as the projecting light L4, L5.

Then, in Step 4, a processing is performed that a displacement between the target brightness-intensity pattern (FIG. 11) obtained by the processing in the above Step 2 and the brightness-intensity distribution pattern (FIG. 2 or 3) obtained by the processing in the above Step 3 is calculated. The displacement occurs due to the light refraction in the concave lens 4 or the convex lens 5, as has been explained previously with reference to FIGS. 1 to 3.

Next, in Step 5 and Step 6, a processing is performed that the reflector 6 for the concave lens 4 or the reflector 7 for the convex lens 5 is primarily set in place of the provisionally set reflector 2 such that the displacement which has been calculated by the processing in the above Step 4 becomes 0. That is, the free curved surfaces of NUBBS for the reflector 2, 6, 7 are automatically modified and deformed to form optimal free curved surfaces of NURBS such that the brightness-intensity distribution pattern (FIG. 2 or FIG. 3) obtained by the processing in the above Step 3 is coincide with the target brightness-intensity distribution pattern (FIG. 11) obtained by the processing in the above Step 2. In the processings in Step 5 and Step 6, Ray-tracing calculation is repeated where the light L1, L14, L15 from the light source 1 is reflected by the reflector 2, 6, 7, the reflected light L2, L24, L25 is refracted by the lens 3, 4, 5 and the refracted light reaches a screen (not shown) ahead of the lens as the projecting light L3, L4, L34, L5, L35.

Next, when the displacement becomes almost 0, the primarily set of the reflector 6 for the concave lens 4 or the reflector 7 for the convex lens 5 is completed. In Step 7, data of the primarily set reflector 6 for the concave lens 4 or the primarily reflector 7 for the convex lens 5 is output.

In this manner, according to the method for manufacturing a reflector of the present invention in the embodiment, the reflector 6, 7 for a headlamp whose interior is made difficult to see to some extent without losing a high brightness feeling of inside metal and which has a high degree of freedom on an optical design can be manufactured. In addition, the processings in the above-mentioned Steps 2, 3, 4, 5, 6, namely the step of provisionally setting the reflector 2, the step of calculating displacement, and the step of primarily setting the reflector 6, 7, are performed according to a predetermined program in a computer so that the above-mentioned reflector 6, 7 for a headlamp can be manufactured with a high accuracy, at a high speed and with a high degree of freedom.

Next, results which have been obtained by trying optical design simulations for headlamps having the concave lens and the convex lens of the present invention and a headlamp having a conventional flat lens will be explained in detail.

Figures 6A, 6B, 6C, 6D:
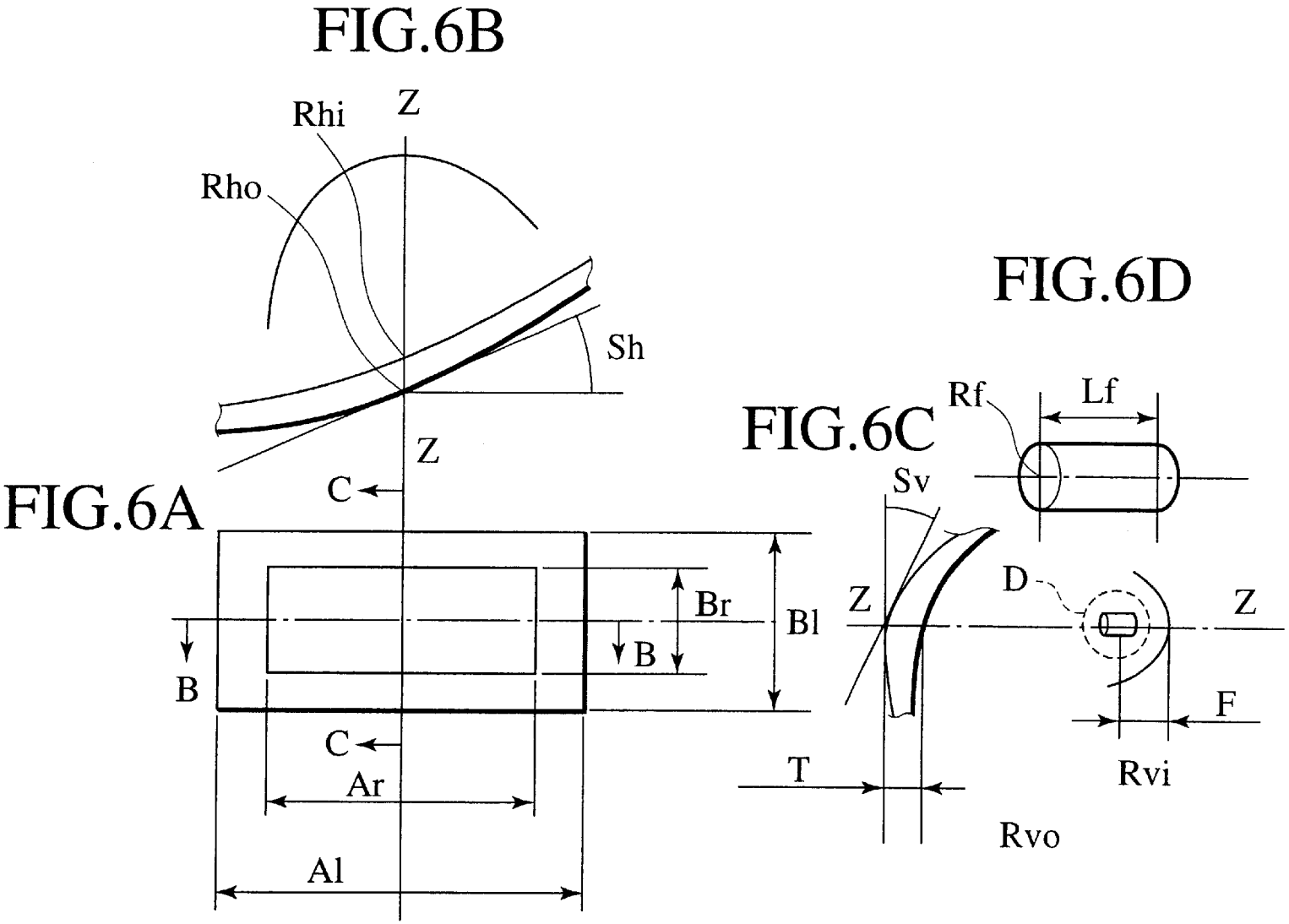
FIGS. 6A to 6D are explanatory diagrams showing data to be input in simulation for optical system design, FIG. 6A being a front view, FIG. 6B being a sectional view taken along line B—B in FIG. 6A, FIG. 6C being a sectional view taken along line C—C in FIG. 6A, and FIG. 6D being an enlarged view of a D portion in FIG. 6C.

FIG. 6 is an explanatory diagram showing data input for optical design simulations.

Ar = length size (mm) of reflector 2, 6, 7
Br = height size (mm) of reflector 2, 6, 7
A1 = length size (mm) of lens 3, 4, 5
B1 = height size (mm) of lens 3, 4, 5
T = thickness size (mm) (in optical axis Z—Z) of lens 3, 4, 5
Sv = side surface inclination angle (°) (in optical axis Z—Z) of lens 3, 4, 5
Sh = flat surface inclination angle (°) (in optical axis Z—Z) of lens 3, 4, 5
Rvo = radius of curvature (mm) in side view optical axis Z—Z of surface of lens 3, 4, 5
Rho = radius of curvature (mm) in plan view optical axis Z—Z of surface of lens 3, 4, 5
Rvi = radius of curvature (mm) in side view optical axis Z—Z of back surface of lens 3, 4, 5
Rhi = radius of curvature (mm) in plan view optical axis Z—Z of back surface of lens 3, 4, 5
F = focal distance (mm)
Lf = length (mm) of filament
Rf = radius (mm) of filament The above-mentioned data is input as values shown in FIG. 13, FIG. 14 and FIG. 15. Incidentally, as conditions, EC brightness-intensity distribution standard ECEReg is met and the sizes of reflectors and light sources are identical.

According to the headlamp having a flat lens, The results shown in FIG. 16 can be obtained.

Also, according to the headlamp having the concave lens of the present invention, the results shown in FIG. 17 can be obtained.

Furthermore, according to the headlamp having the convex lens, the results shown in FIG. 18 can be obtained.

The following results shown in FIG. 19 can be obtained collectively in view of the above-mentioned FIG. 16, FIG. 17 and FIG. 18.

As apparent from FIG. 19, in a case that the sizes of the reflectors are set to be constant, the following conclusion can be obtained.

That is, in the headlamp of the present invention having the concave lens, the utilization light rays is increased by 13%, the light projecting area of the lens is reduced by 15%, and the depth of the reflector is increased by 5%, as compared with the conventional headlamp having the flat lens. On the other hand, in the headlamp of the present invention having the convex lens, the utilization light rays is decreased by 18%. The light projecting area of the lens is increased by 21% and the depth of the reflector is reduced by 10%, as compared with the conventional headlamp having the flat lens.

As mentioned forth above, when it is desired to make brighter and make the light emitting area of a lens smaller, a headlamp using a concave lens is suitable. Also, when it is desired to make the depth of a reflector smaller and make the light projecting area of a lens larger, a headlamp using a convex lens is suitable.

Figure 7A:
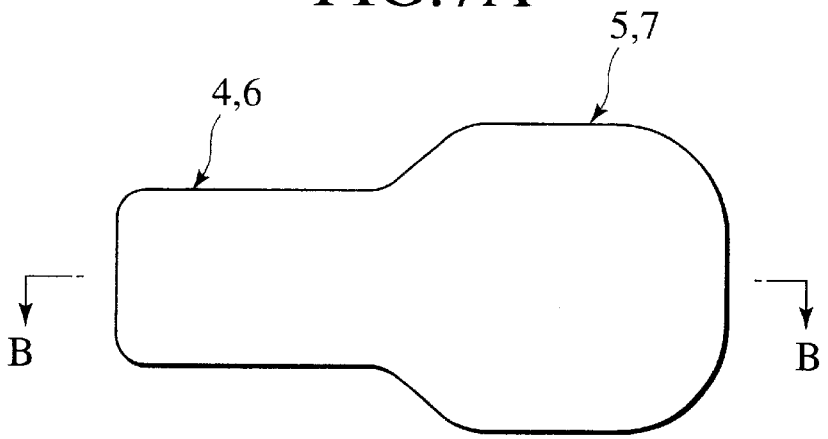
FIGS. 7A and 7B are a modified embodiment of a headlamp of the present invention, FIG. 7A being a front view and FIG. 7B being a sectional view taken along line B—B in FIG. 7A.
Figure 7B:
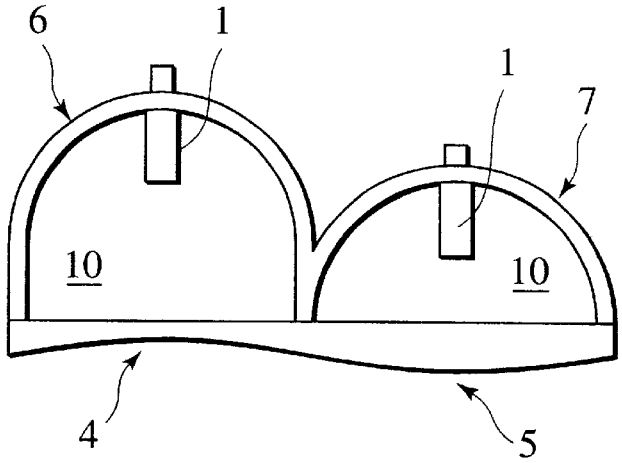

FIGS. 7A and 7B show a modified embodiment of a headlamp of the present invention, where FIG. 7A is a front view and FIG. 7B is a sectional view taken along line B—B in FIG. 7A.

The headlamp of the modified embodiment is constituted by combination of a concave lens 4 and a reflector 6 for the concave lens 4, and a convex lens 5 and a reflector 7 for the convex lens 5.

Incidentally, in the above embodiments, the headlamp which can obtain the brightness-intensity distribution pattern of a low light rays has been explained, but the present invention is applicable to a headlamp which can obtain a brightness-intensity distribution pattern of a high light rays.

As apparent from the above, the headlamp of the present invention makes it difficult to some extent to see an inside thereof without losing a high brightness feeling of inside metal and has a high degree of freedom on optical system design.

Also, according to the method for manufacturing a reflector for the headlamp of the present invention, a reflector for a headlamp whose inside is made difficult to some extent to see without losing a high brightness feeling of inside metal and which has a high degree of freedom on optical system design can be manufactured.

While preferred embodiments of the present invention have been described using specific terms, such description is for illustrative purposes, and it is to be understood that changes and variations may be made without departing from the spirit or scope of the following claims.

What is claimed is:

1. A method for determining a reflective surface of a reflector for a headlamp comprising the steps of:

providing a light source on an optical axis for emitting light;

providing a reflector about the optical axis for reflecting the light;

providing a flat lens about the optical axis and opposite to the reflector for transmitting reflected light therethrough;

determining a provisional reflective surface of a B-spline surface of the reflector, so that first light reflected by the provisional reflective surface transmits through the flat lens to project as a first brightness distribution pattern in conformance with a reference brightness distribution pattern;

replacing the flat lens with a curved lens for transmitting second light reflected by the provisional reflective surface through the curved lens to project as a second brightness distribution pattern;

determining a difference between the reference brightness distribution pattern and the second brightness distribution pattern; and determining a primary reflective surface of a B-spline surface of the reflector, so that third light reflected by the primary reflective surface transmits through the curved lens to be substantially parallel with said first light and to project as a third brightness distribution pattern to substantially cancel said difference.

2. A headlamp having a reflector with a primary reflective surface, comprising:

a light source on an optical axis for emitting light;

a reflector including a primary reflective surface of a B-spline surface about the optical axis for reflecting light emitted from the light source; and a curved lens positioned about the optical axis and opposite to the primary reflective surface for transmitting therethrough light reflected by the primary reflective surface to project as second and third brightness distribution patterns;

wherein the curved lens has a concave surface.

3. A headlamp having a reflector with a primary reflective surface, comprising:

a light source on an optical axis for emitting light;

a reflector including a primary reflective surface of a B-spline surface about the optical axis for reflecting light emitted from the light source; and a curved lens positioned about the optical axis and opposite to the primary reflective surface for transmitting therethrough light reflected by the primary reflective surface to project as second and third brightness distribution patterns;

wherein the curved lens has a convex surface.

4. A headlamp having a reflector with a primary reflective surface, comprising:

a light source on an optical axis for emitting light;

a reflector including a primary reflective surface of a B-spline surface about the optical axis for reflecting light emitted from the light source; and a curved lens positioned about the optical axis and opposite to the primary reflective surface for transmitting therethrough light reflected by the primary reflective surface to project as second and third brightness distribution patterns;

wherein the curved lens has a concave surface and a convex surface, the primary reflective surface of the reflector conforms a fourth brightness-intensity distribution pattern to transmit through the concave surface and a fifth brightness distribution pattern to transmit through the convex surface to a reference brightness distribution pattern respectively.

5. A headlamp having a reflector with a primary reflective surface, comprising:

a light source on an optical axis for emitting light;

a reflector including a primary B-spline reflective surface about the optical axis for reflecting light emitted from the light source; and a curved lens positioned about the optical axis and opposite to the primary reflective surface for transmitting therethrough light reflected by the primary reflective surface to project as a brightness distribution pattern;

wherein the curved lens has a concave surface.

6. A headlamp having a reflector with a primary reflective surface, comprising:

a light source on an optical axis for emitting light;

a reflector including a primary B-spline reflective surface about the optical axis for reflecting light emitted from the light source; and a curved lens positioned about the optical axis and opposite to the primary reflective surface for transmitting therethrough light reflected by the primary reflective surface to project as a brightness distribution pattern;

wherein the curved lens has a convex surface.

7. A headlamp having a reflector with a primary reflective surface, comprising:

a light source on an optical axis for emitting light;

a reflector including a primary B-spline reflective surface about the optical axis for reflecting light emitted from the light source; and a curved lens positioned about the optical axis and opposite to the primary reflective surface for transmitting therethrough light reflected by the primary reflective surface to project as a brightness distribution pattern;

wherein the curved lens has a concave surface and a convex surface.

* * * * *